US007299625B2

(12) United States Patent
Uchida et al.

(10) Patent No.: US 7,299,625 B2
(45) Date of Patent: Nov. 27, 2007

(54) EXHAUST PURIFYING APPARATUS AND EXHAUST PURIFYING METHOD FOR INTERNAL COMBUSTION ENGINE

(75) Inventors: Takahiro Uchida, Toyota (JP); Tatsumasa Sugiyama, Anjyo (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 32 days.

(21) Appl. No.: 11/085,127

(22) Filed: Mar. 22, 2005

(65) Prior Publication Data

US 2005/0217254 A1 Oct. 6, 2005

(30) Foreign Application Priority Data

Apr. 1, 2004 (JP) ..... 2004-108991

(51) Int. Cl.
*F01N 3/00* (2006.01)

(52) U.S. Cl. ..... 60/277; 60/295

(58) Field of Classification Search ..... 60/277, 60/295

See application file for complete search history.

(56) References Cited

U.S. PATENT DOCUMENTS

| | | | | |
|---|---|---|---|---|
| 6,381,952 | B1 * | 5/2002 | Asanuma et al. | 60/284 |
| 6,460,329 | B2 * | 10/2002 | Shimotani et al. | 60/285 |
| 6,588,205 | B1 * | 7/2003 | Kumagai et al. | 60/298 |
| 6,698,187 | B2 * | 3/2004 | Nishioka et al. | 60/277 |
| 2004/0177605 | A1 * | 9/2004 | Kojima et al. | 60/274 |

FOREIGN PATENT DOCUMENTS

| | | |
|---|---|---|
| DE | 19961165 | 8/2001 |
| DE | 10238056 | 3/2003 |
| DE | 10156476 | 6/2003 |
| EP | 1 041 263 A2 | 10/2000 |
| JP | 2001-059415 | 3/2001 |

OTHER PUBLICATIONS

French Search Report dated Jul. 7, 2005.
German Language Version of German Office Action for Appln. No. 10 2005 014 757.7-26 issued Aug. 4, 2006.
English Translation of German Office Action for Appln. No. 10 2005 014 757.7-26 issued Aug. 4, 2006.

* cited by examiner

*Primary Examiner*—Thomas Denion
*Assistant Examiner*—Loren Edwards
(74) *Attorney, Agent, or Firm*—Kenyon & Kenyon LLP

(57) ABSTRACT

During sulfur release control in an internal combustion engine, a rich period and a lean period are alternately repeated. The air-fuel ratio of exhaust gas is controlled toward a target air-fuel ratio (14.3) by adding fuel from a fuel adding valve in the rich period. An ECU determines whether the actual air-fuel ratio of exhaust gas detected by an air-fuel ratio sensor has reached a stoichiometric air-fuel ratio each time the rich period ends at which addition of fuel from the fuel adding valve is stopped. A counter counts the number of times the ECU has determined that the actual air-fuel ratio of exhaust gas has not reached the stoichiometric air-fuel ratio. When the value of the counter becomes greater than or equal to a permissible value, the ECU determines that there is an abnormality in the sulfur release control.

15 Claims, 3 Drawing Sheets

EXHAUST PURIFYING APPARATUS AND EXHAUST PURIFYING METHOD FOR INTERNAL COMBUSTION ENGINE

BACKGROUND OF THE INVENTION

The present invention relates to an exhaust purifying apparatus and an exhaust purifying method for an internal combustion engine.

An exhaust purifying catalyst for an internal combustion engine that performs lean combustion such as a diesel engine, particularly, a NOx storage-reduction catalyst is poisoned by sulfur components contained in fuel. If the level of poisoning is high, the NOx storage-reduction capacity of the NOx storage-reduction catalyst is decreased. Therefore, when the NOx storage-reduction catalyst is poisoned by the sulfur components to a certain level, that is, when the sulfur components have accumulated in the NOx storage-reduction catalyst by a certain amount, a sulfur release control is performed to release the sulfur components from the catalyst. In the sulfur release control, while maintaining the catalyst bed temperature high, the air-fuel ratio of exhaust gas detected by an air-fuel ratio sensor is subjected to feedback control to be equal to either a stoichiometric air-fuel ratio or a target air-fuel ratio that is richer than the stoichiometric air-fuel ratio. Richening of the air-fuel ratio while the catalyst bed temperature is maintained high causes the sulfur components to be released from the NOx storage-reduction catalyst.

The procedure for the sulfur release control is disclosed in Japanese Laid-Open Patent Publication No. 2001-59415. Hereinafter, the sulfur release control will be described using Japanese Laid-Open Patent Publication No. 2001-59415 as an example.

According to the sulfur release control disclosed in Japanese Laid-Open Patent Publication No. 2001-59415, 700° C. conversion S release time Tre computed by the following equation (1) is used as an index for determining whether release of the sulfur components from the NOx storage-reduction catalyst performed by the sulfur release control has been completed.

$$Tre\ (i)=Tre\ (i-1)+Ky\times Tcal \quad (1)$$

Where:

Tre(i): Current 700° C. conversion S release time

Tre(i−1): Previous 700° C. conversion S release time

Ky: Coefficient of sulfur release speed

Tcal: Fuel injection amount calculation cycle

The computation of the 700° C. conversion S release time Tre using the equation (1) is performed when the air-fuel ratio of exhaust gas is equal to or richer than the stoichiometric air-fuel ratio regardless of whether the sulfur release control is being executed.

The 700° C. conversion S release time Tre computed using the equation (1) is an accumulation of time during which the air-fuel ratio of exhaust gas becomes equal to or richer than the stoichiometric air-fuel ratio and sulfur components are released, the time being converted to sulfur release time when the sulfur release control is performed with the catalyst bed temperature set to 700° C. The coefficient of sulfur release speed Ky in the equation (1) is the ratio between the release speed of the sulfur components when the catalyst bed temperature is set to 700° C. and the release speed of the sulfur components at the catalyst bed temperature of the current calculation. The coefficient of sulfur release speed Ky is obtained in accordance with the catalyst bed temperature. The fuel injection amount calculation cycle Tcal is a time interval between the previous calculation of the fuel injection amount of the internal combustion engine and the current calculation of the fuel injection amount.

After the sulfur release control is started, when the 700° C. conversion S release time Tre reaches a reference value Treo, which is a value corresponding to the time at which release of the sulfur components are completed when the catalyst bed temperature is 700° C., the sulfur release control is determined to be completed.

According to the sulfur release control disclosed in the above publication, either a slow temperature increase mode or a fast temperature increase mode is selected as the operation mode of the internal combustion engine during the control. The increasing speed of the catalyst bed temperature differs between the slow temperature increase mode and the fast temperature increase mode. More specifically, the slow temperature increase mode is selected as the operation mode immediately after the sulfur release control is started. If the 700° C. conversion S release time Tre does not reach the reference value Treo although the execution time TL of the sulfur release control in the slow temperature increase mode becomes greater than or equal to a reference value TL0, the slow temperature increase mode is switched to the fast temperature increase mode, which easily increases the catalyst bed temperature as compared to the slow temperature increase mode, to promote release of sulfur from the NOx storage-reduction catalyst.

If, for example, the air-fuel ratio sensor malfunctions and outputs only signals indicating the lean state during the feedback control of the sulfur release control, the air-fuel ratio of exhaust gas is determined to be lean although it is actually rich. Thus, addition of the 700° C. conversion S release time Tre is not performed. In this case, the 700° C. conversion S release time Tre does not reach the reference value Treo although the sulfur release control is continuously performed. Therefore, the sulfur release control cannot be ended.

In this respect, in the above publication, if the 700° C. conversion S release time Tre does not reach the reference value Treo although the actual time TL of the slow temperature increase mode has reached the reference value TL0 and the actual time TH of the subsequent fast temperature increase mode has reached the reference value TH0, the sulfur release control is determined to have caused an abnormality. As described above, by determining the existence of abnormality in the sulfur release control, measures can be taken to solve the abnormality.

However, in the above publication, the occurrence of abnormality in the control is determined only based on a fact that a predetermined time (TL0+TH0) has elapsed from when the sulfur release control has been started. The existence of abnormality is not determined in accordance with the air-fuel ratio of exhaust gas, which is directly affected by the abnormality. In other words, the existence of abnormality is determined based on a phenomenon that is indirectly caused by the abnormality, which has occurred in the sulfur release control.

In a case where the existence of an abnormality is determined based on a parameter that is indirectly affected by the abnormality that has occurred in the sulfur release control, that is, based on only the actual time of the sulfur release control, if the predetermined time (TL0+TH0) is set to a relatively short time, there may be an error in the determination of whether an abnormality has occurred in the sulfur release control. For example, the increase of the 700°

C. conversion S release time Tre is delayed under circumstances where the catalyst bed temperature does not easily rise or the engine is running at a low speed during which the calculation cycle of the fuel injection amount is lengthened. In this case, although there is no abnormality in the sulfur release control, the actual time of the sulfur release control may reach the predetermined time (TL0+TH0) before the 700° C. conversion S release time Tre reaches the reference value Treo. As a result, an erroneous determination may be made that the control has caused an abnormality.

To avoid such an erroneous determination, the predetermined time (TL0+TH0) may be set longer so that the fact that the predetermined time (TL0+TH0) has elapsed from when the sulfur release control has been started reliably represents occurrence of an abnormality in the sulfur release control. However, if the predetermined time (TL0+TH0) is set longer, it takes time to make a determination as to when an abnormality actually occurs in the sulfur release control. This delays measures to be taken in response to the abnormality based on the determination result.

SUMMARY OF THE INVENTION

Accordingly, it is an objective of the present invention to provide an exhaust purifying apparatus for an internal combustion engine, the internal combustion engine, and an exhaust purifying method for an internal combustion engine that promptly and accurately determine the existence of an abnormality in sulfur release control, which causes an exhaust purifying catalyst to release sulfur.

To achieve the foregoing and other objectives and in accordance with the purpose of the present invention, an exhaust purifying apparatus for sulfur release control in an internal combustion engine that performs lean combustion is provided. The engine has an exhaust purifying catalyst that is caused to release sulfur accumulated from exhaust gas produced. The exhaust purifying apparatus includes detecting means, determining means, and abnormality diagnosing means. The detecting means detects the air-fuel ratio of exhaust gas of the internal combustion engine. The determining means repeatedly determines at a predetermined timing during a feedback control, whether the air-fuel ratio detected by the detecting means has reached a predetermined value at which sulfur is released from the exhaust purifying catalyst. The abnormality diagnosing means counts the number of times the determining means has determined that the air-fuel ratio has not reached the predetermined value. When the number of times becomes greater than or equal to a permissible value, the abnormality diagnosing means determines that there is an abnormality in the sulfur release control. When executing sulfur release control, the feedback control is executed to equalize the air-fuel ratio with either of a stoichiometric air-fuel ratio or a target air-fuel ratio richer than the stoichiometric air-fuel ratio by selectively increasing and decreasing a correction value for richening the air-fuel ratio of exhaust gas of the internal combustion engine in accordance with said air-fuel ratio.

The present invention also provides an internal combustion engine that performs lean combustion. The engine produces motive force by taking in air and fuel and produces exhaust gas containing sulfur during operation. The internal combustion engine includes an exhaust purifying catalyst and an exhaust purifying apparatus. The exhaust purifying catalyst accumulates sulfur contained in the exhaust gas for purifying the exhaust gas. The exhaust purifying apparatus executes a sulfur release control for causing the exhaust purifying catalyst to release the sulfur. In the sulfur release control, the apparatus executes a feedback control to equalize the air-fuel ratio with either of a stoichiometric air-fuel ratio or a target air-fuel ratio richer than the stoichiometric air-fuel ratio by selectively increasing and decreasing a correction value for richening the air-fuel ratio of the exhaust gas in accordance with the air-fuel ratio. The exhaust purifying apparatus includes detecting means, determining means, and abnormality diagnosing means. The detecting means detects the air-fuel ratio of the exhaust gas. The determining means repeatedly determines at a predetermined timing during the feedback control, whether the air-fuel ratio detected by the detecting means has reached a predetermined value at which sulfur is released from the exhaust purifying catalyst. The abnormality diagnosing means counts the number of times the determining means has determined that the air-fuel ratio has not reached the predetermined value. When the number of times becomes greater than or equal to a permissible value, the abnormality diagnosing means determines that there is an abnormality in the sulfur release control.

Further, the present invention provides an exhaust purifying method for an internal combustion engine that performs lean combustion. In the method, a sulfur release control is executed for releasing, from an exhaust purifying catalyst, sulfur that accumulates from exhaust gas. The exhaust purifying method includes: executing feedback control to equalize the air-fuel ratio with either of a stoichiometric air-fuel ratio or a target air-fuel ratio richer than the stoichiometric air-fuel ratio by selectively increasing and decreasing a correction value for richening the air-fuel ratio of the exhaust gas in accordance with the air-fuel ratio; detecting the air-fuel ratio of the exhaust gas; repeatedly determining at a predetermined timing during said executing feedback control, whether the air-fuel ratio detected during said detecting has reached a predetermined value at which sulfur is released from the exhaust purifying catalyst; and counting the number of times the air-fuel ratio is determined not to have reached the predetermined value in said repeatedly determining, and when the number of times becomes greater than or equal to a permissible value, diagnosing that there is an abnormality in the sulfur release control.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 2(*b*) is a time chart showing changes in the air-fuel ratio of exhaust gas during the S release control;

FIG. 2(*c*) is a time chart showing changes in a ratio K during the S release control;

FIG. 2(*d*) is a time chart showing changes in an integral term qi during the S release control.

DETAILED DESCRIPTION OF THE PREFERRED EMBODIMENTS

An exhaust purifying apparatus for a vehicle diesel engine according to one embodiment of the present invention will be described with reference to the drawings.

Figure 1:
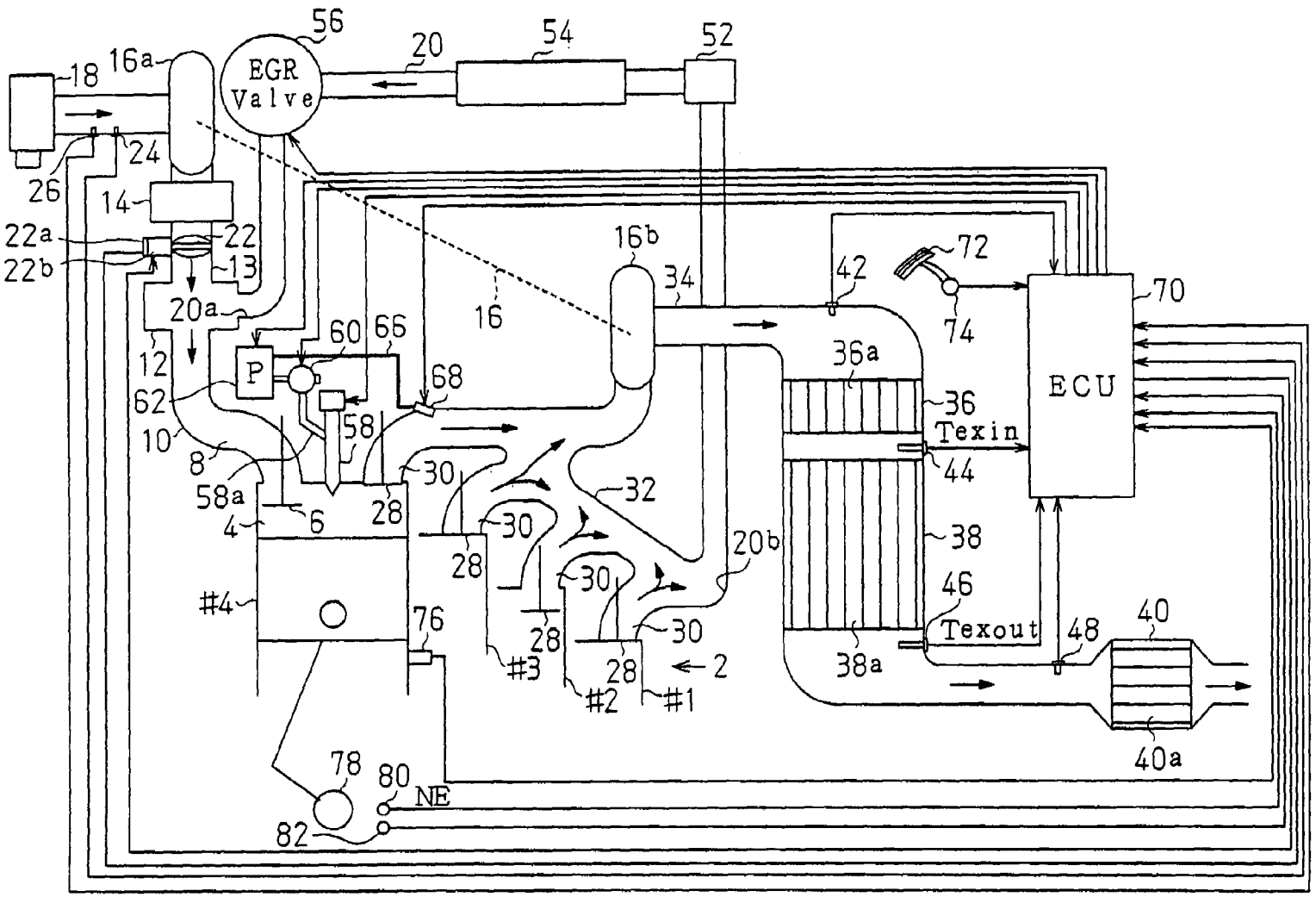
FIG. 1 is a view illustrating a diesel engine according to a preferred embodiment of the present invention.

As shown in FIG. 1, the diesel engine 2 has cylinders. In this embodiment, the number of the cylinders is four, and the cylinders are denoted as #1, #2, #3, and #4. A combustion chamber 4 for each of the cylinders #1 to #4 includes an intake port 8, which is opened and closed by an intake valve 6. The combustion chambers 4 are connected to a surge tank 12 via the intake ports 8 and an intake manifold 10. The surge tank 12 is connected to an intercooler 14 and the outlet of a compressor 16*a* of an exhaust turbocharger 16 with an intake passage 13. The inlet of the compressor 16*a* is connected to an air cleaner 18. An exhaust gas recirculation passage 20 (hereinafter, referred to as EGR) is connected to the surge tank 12. Specifically, an EGR gas supply port 20*a* of the EGR passage 20 opens to the surge tank 12. A throttle valve 22 is located in a section of the intake passage 13 between the surge tank 12 and the intercooler 14. An intake flow rate sensor 24 and an intake temperature sensor 26 are located between the compressor 16*a* and the air cleaner 18.

The combustion chamber 4 of each of the cylinders #1 to #4 includes an exhaust port 30, which is opened and closed by an exhaust valve 28. The combustion chambers 4 are connected to an inlet of an exhaust turbine 16*b* of the exhaust turbocharger 16 via the exhaust ports 30 and an exhaust manifold 32. An outlet of the exhaust turbine 16*b* is connected to an exhaust passage 34. The exhaust turbine 16*b* draws exhaust gas into the exhaust passage 34 from a section of the exhaust manifold 32 that corresponds to the side of the fourth cylinder #4.

Three catalytic converters 36, 38, 40 each containing an exhaust purifying catalyst are located in the exhaust passage 34. The first catalytic converter 36 located at the most upstream section contains a NOx storage-reduction catalyst 36*a*. When exhaust gas is regarded as an oxidizing atmosphere (lean) during normal operation of the diesel engine 2, the NOx storage-reduction catalyst 36*a* stores NOx. When exhaust gas is regarded as a reducing atmosphere (stoichiometric or air-fuel ratio lower than the stoichiometric air-fuel ratio), the NOx storage-reduction catalyst 36*a* releases the stored NOx as nitrogen oxide (NO), which is, in turn, reduced with carbon hydride (HC) and carbon monoxide (CO) in exhaust gas. NOx is purified in this manner.

The second catalytic converter 38 containing a filter 38*a* is located at the second position from the most upstream side. The filter 38*a* has a monolithic wall. The wall has pores through which exhaust gas passes. The surface of the pores of the filter 38*a* is coated with a layer of a NOx storage-reduction catalyst. Therefore, NOx is purified in the second catalytic converter 38 in the same manner as the first catalytic converter 36. Further, the wall of the filter 38*a* traps particulate matter (hereinafter, referred to as PM) in exhaust gas. Thus, active oxygen, which is generated in a high-temperature oxidizing atmosphere when NOx is stored, starts oxidizing the trapped PM. Further, ambient excessive oxygen oxidizes the entire PM. Accordingly, PM is purified at the same time as NOx is purified. In this embodiment, the first catalytic converter 36 and the second catalytic converter 38 are formed integrally.

The third catalytic converter 40 is located in the most downstream section. The third catalytic converter 40 contains an oxidation catalyst 40*a*, which oxidizes and purifies HC and CO in exhaust gas.

A first exhaust temperature sensor 44 is located between the NOx storage-reduction catalyst 36*a* and the filter 38*a*. A second exhaust temperature sensor 46 and an air-fuel ratio sensor 48 are located between the filter 38*a* and the oxidation catalyst 40*a*. The second exhaust temperature sensor 46 is closer to the filter 38*a* than the oxidation catalyst 40*a*. The air-fuel ratio sensor 48 is located closer to the oxidation catalyst 40*a* than the filter 38*a*.

The air-fuel ratio sensor 48 detects the air-fuel ratio of exhaust gas based on components of the exhaust gas. The air-fuel ratio sensor 48 outputs a voltage signal in proportion to the detected air-fuel ratio. The first exhaust temperature sensor 44 detects an exhaust temperature Texin at the corresponding position. Likewise, the second exhaust temperature sensor 46 detects an exhaust temperature Texout at the corresponding position.

An EGR gas intake port 20*b* of the EGR passage 20 is provided in the exhaust manifold 32. The EGR gas intake port 20*b* is open at a section that corresponds to the side of the first cylinder #1, which is opposite to the side of the fourth cylinder #4, at which the exhaust turbine 16*b* introduces exhaust gas to the exhaust passage 34.

An iron based EGR catalyst 52 and an EGR cooler 54 are located in the EGR passage 20 in this order from the EGR gas intake port 20*b*. The iron based EGR catalyst 52 functions to reform EGR gas and to prevent clogging of the EGR cooler 54. The EGR cooler 54 cools EGR gas. An EGR valve 56 is located upstream of the EGR gas supply port 20*a*. The opening degree of the EGR valve 56 is changed to adjust the amount of EGR gas supplied from the EGR gas supply port 20*a* to the intake system.

A fuel injection valve 58 is provided at each of the cylinders #1 to #4 to directly inject fuel into the corresponding combustion chamber 4. The fuel injection valves 58 are connected to a common conduit or rail 60 with fuel supply conduits or pipes 58*a*. A variable displacement fuel pump 62, which is electrically controlled, supplies high pressure fuel to the common rail 60. High pressure fuel supplied from the fuel pump 62 to the common rail 60 is distributed to the fuel injection valves 58 through the fuel supply pipes 58*a*.

Further, the fuel pump 62 also supplies low pressure fuel to a fuel adding valve 68 through a fuel supply pipe 66. The fuel adding valve 68 is provided in the exhaust port 30 of the fourth cylinder #4 and injects fuel to the exhaust turbine 16*b*. In this manner, fuel adding valve 68 adds fuel to exhaust gas. A catalyst control mode, which is described below, is executed by such addition of fuel.

An electronic control unit (hereinafter, referred to as ECU) 70 is mainly composed of a digital computer having a CPU, a ROM, and a RAM, and drive circuits for driving other devices. The ECU 70 reads signals from the intake flow rate sensor 24, the intake temperature sensor 26, the first exhaust temperature sensor 44, the second exhaust temperature sensor 46, the air-fuel ratio sensor 48, an EGR opening degree sensor in the EGR valve 56, and a throttle opening degree sensor 22*a*. Further, the ECU 70 reads signals from an acceleration pedal sensor 74 that detects the depression degree of an acceleration pedal 72, or an acceleration pedal depression degree ACCP, a coolant temperature sensor 76 that detects the temperature of coolant THW of the diesel engine 2, an engine speed sensor 80 that detects the number of revolutions NE of a crankshaft 78, and a cylinder distinguishing sensor 82 that distinguishes cylinders by detecting the rotation phase of the crankshaft 78 or the rotation phase of the intake cams.

Based on the operating condition of the engine 2 obtained from these signals, the ECU 70 controls the amount and the timing of fuel injection by the fuel injection valve 58. Further, the ECU 70 controls the opening degree of the EGR valve 56, the throttle opening degree with the motor 22*b*, and the displacement of the fuel pump 62. Also, the ECU 70 executes PM release control and sulfur (hereinafter referred to as S poisoning) release control.

The ECU 70 selects one of a normal combustion mode and a low temperature combustion mode according to the operating condition of the engine. The low temperature combustion mode refers to a combustion mode in which an EGR opening degree map for the low temperature combustion mode is used for recirculating a large amount of exhaust gas to slow down the increase of the combustion temperature, thereby simultaneously reducing NOx and smoke. The low temperature combustion mode of this embodiment is executed in a low load, low-to-middle rotation speed region, and air-fuel ratio feedback control is performed by adjusting the throttle opening degree TA based on the air-fuel ratio AF detected by the air-fuel ratio sensor 48. The other combustion mode is the normal combustion mode, in which a normal EGR control (including a case where no EGR is executed) is performed using an EGR opening degree map for the normal combustion mode.

The ECU 70 performs four catalyst control modes, which are modes for controlling the exhaust purifying catalyst. The catalyst control modes include a PM release control mode, an S release control mode, a NOx reduction control mode, and a normal control mode. In the PM release control mode, PM deposited on the filter 38*a* in the second catalytic converter 38 is heated and burned. PM is then changed to $CO_2$ and $H_2O$ and discharged. In this mode, a temperature increase process is executed, in which addition of fuel from the fuel adding valve 68 is repeated in an air-fuel ratio higher than the stoichiometric air-fuel ratio so that the catalyst bed temperature is increased to a high temperature which is, for example, in a range from 600° C. to 700° C.

In the S release control mode, if the NOx storage-reduction catalyst 36*a* and filter 38*a* are poisoned and the NOx storage capacity is lowered, sulfur components (S components) are released so that the catalyst 36*a* and the filter 38*a* are restored from the S poisoning. In this mode, addition of fuel from the fuel adding valve 68 is repeated so that the catalyst bed temperature is increased (for example, to 650° C.). Further, by intermittently adding fuel from the fuel adding valve 68, the air-fuel ratio is lowered to or slightly below the stoichiometric air-fuel ratio.

In the NOx reduction control mode, NOx stored in the NOx storage-reduction catalyst 36*a* and the filter 38*a* is reduced to $N_2$, $CO_2$, and $H_2O$ and emitted. In this mode, addition of fuel from the fuel adding valve 68 is intermittently performed at a relatively long interval so that the catalyst bed temperature becomes relatively low (for example, to a temperature in a range from 250° C. to 500° C.). Accordingly, the air-fuel ratio is lowered to or below the stoichiometric air-fuel ratio.

Next, the S release control procedure in the S release control mode executed by the ECU 70 will be described.

In the S release control procedure, a temperature increase control and an S release control are performed. The temperature increase control increases the catalyst bed temperature to a target temperature (for example, 650° C.). After the catalyst bed temperature is increased to the target temperature, the S release control causes the catalyst to release the S components by adding fuel from the fuel adding valve 68 so that the air-fuel ratio becomes slightly richer than the stoichiometric air-fuel ratio. The requirement for executing the S release control procedure may be that the S poisoning amount Si of the NOx storage-reduction catalyst 36*a* and the filter 38*a* is greater than or equal to a predetermined upper limit. The S poisoning amount Si is computed based on the following equation (2) at, for example, every fuel injection timing of the diesel engine 2.

$$Si=Si-1+SU+SD \tag{2}$$

Where:

Si: Current S poisoning amount

Si−1: Previous S poisoning amount

SU: S increased amount

SD: S decreased amount

In the equation (2) above, the previous S poisoning amount Si−1 is one of the S poisoning amounts calculated at every fuel injection timing and is a value that is calculated at the calculation timing previous to the fuel injection timing at which the current S poisoning amount Si is calculated. The previous S poisoning amount Si−1 is set to zero at the initial calculation of the S poisoning amount Si.

The S increased amount SU in the equation (2) represents the increased amount of S poisoning amount due to sulfur (S) contained in fuel injected by one fuel injection addition from the fuel injection valve 58. To calculate the S increased amount SU, a command value Qfin related to the fuel injection amount calculated at every predetermined cycle, that is, a command value related to the amount of fuel injected by one fuel injection addition is multiplied by a value obtained by dividing a predetermined sulfur concentration N in fuel by 100 (N/100). The value (Qfin×(N/100)) obtained as a result corresponds to the amount of sulfur contained in fuel injected by one fuel injection. The value (Qfin×(N/100)) is multiplied by a coefficient K, which is for converting the parameter of the sulfur amount to the parameter of the S poisoning amount, so that the S increased amount SU is obtained. The coefficient K is obtained by referring to a map in accordance with the air-fuel ratio and the catalyst bed temperature. When the air-fuel ratio is equal to the stoichiometric air-fuel ratio (14.5 in this embodiment), the coefficient K is zero. When the air-fuel ratio is leaner than the stoichiometric air-fuel ratio, the coefficient K increases as the air-fuel ratio becomes leaner and the catalyst bed temperature becomes higher.

The S decreased amount SD in the equation (2) is obtained by referring to a map in accordance with the air-fuel ratio and the catalyst bed temperature. The S decreased amount SD represents the decreased amount of S poisoning amount at a certain air-fuel ratio and the catalyst bed temperature. When the air-fuel ratio is richer than the stoichiometric air-fuel ratio (14.5 in this embodiment), the S decreased amount SD is made to be a value less than zero as the catalyst bed temperature is increased and the air-fuel ratio becomes richer. The S decreased amount SD is maintained at zero when the air-fuel ratio is leaner than the stoichiometric air-fuel ratio.

When the requirement for executing the S release control procedure is satisfied, if the catalyst bed temperature has not reached the target temperature (for example, 650° C.), the temperature increase control is executed. That is, fuel is intermittently added to exhaust gas from the fuel adding valve 68 by a predetermined amount to increase the catalyst bed temperature to the target temperature. When the catalyst bed temperature has reached the target temperature, the S release control is executed. That is, addition of fuel from the fuel adding valve 68 is controlled such that the air-fuel ratio becomes equal to a target air-fuel ratio (14.3 in this embodiment), which is slightly richer than the stoichiometric air-fuel ratio, to cause the catalyst to release sulfur.

When the air-fuel ratio becomes less than or equal to the stoichiometric air-fuel ratio (14.5) with high catalyst bed temperature, the catalyst releases the S components, and the S poisoning amount Si calculated based on the equation (2) decreases in accordance with the S decreased amount SD. When the S poisoning amount Si decreases to a predetermined end determination value (for example, zero), the S release control procedure (S release control) is ended.

The overview of the S release control executed as part of the S release control procedure will now be described with reference to the time chart shown in FIGS. 2(*a*) to 2(*d*).

Figures 2A, 2B, 2C, 2D:
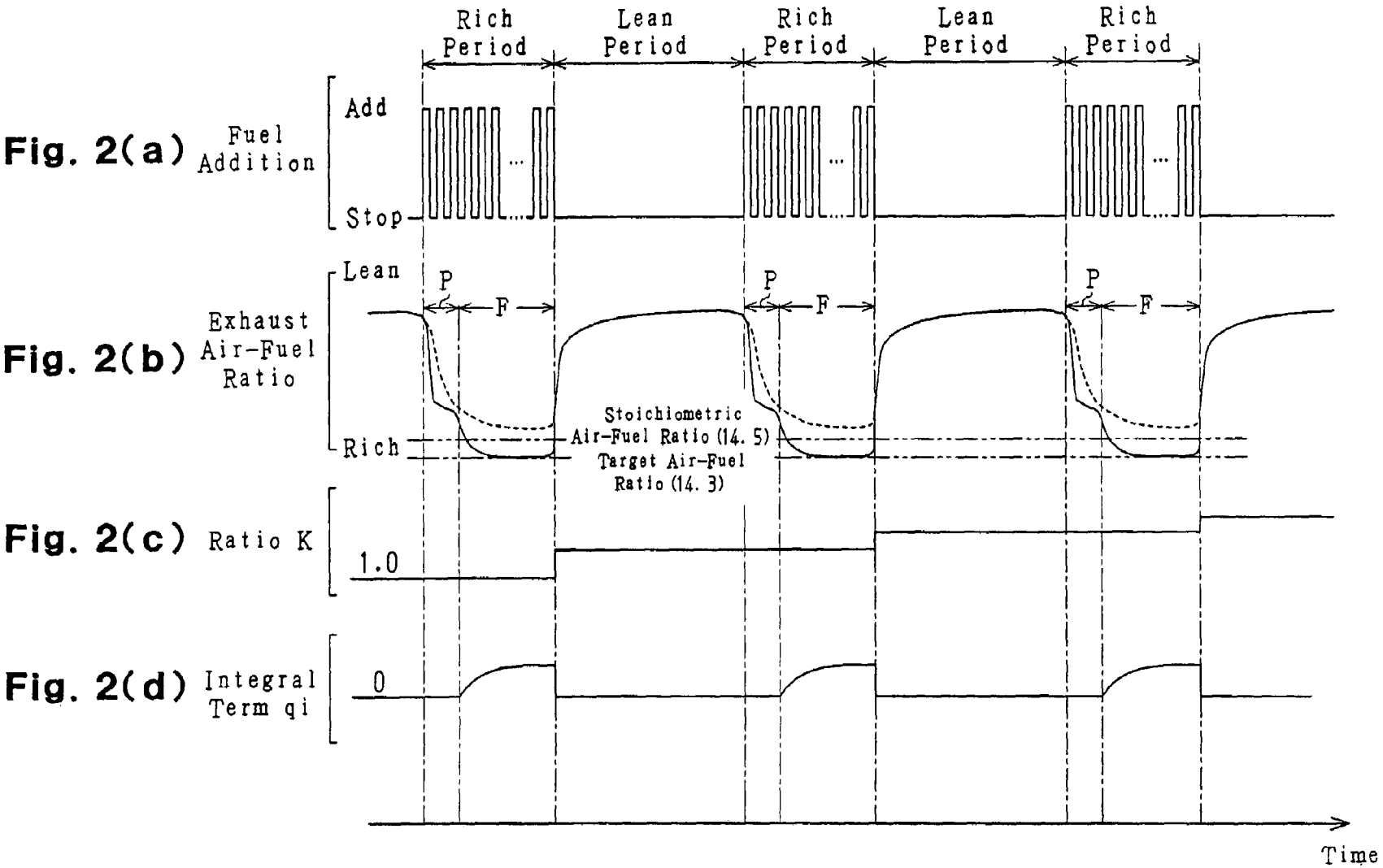
FIG. 2(*a*) is a time chart showing changes in the manner of adding fuel from a fuel adding valve during S release control.

In the S release control, concentrated intermittent addition of fuel from the fuel adding valve 68 is performed as shown in FIG. 2(*a*) to control the air-fuel ratio of exhaust gas to approach the target air-fuel ratio (14.3). However, when the fuel is added as described above, the catalyst bed temperature is also significantly increased. Therefore, a rich period during which fuel is added and a lean period during which addition of fuel is stopped are provided. Repeating the rich period and the lean period suppresses excessive increase of the catalyst bed temperature. As a result, intermittent concentrated fuel addition is repeatedly performed (rich period) and stopped (lean period), and the exhaust air-fuel ratio is repeatedly reversed between a rich state and a lean state as shown by a solid line in FIG. 2(*b*).

When the fuel adding valve 68 starts adding fuel as the lean period is switched to the rich period, added fuel reacts with oxygen absorbed by the catalyst at first. Therefore, at the beginning of fuel addition, most of the oxygen in the exhaust gas that flows into the catalyst flows downstream of the catalyst without reacting with the added fuel. As a result, the air-fuel ratio of exhaust gas detected by the air-fuel ratio sensor 48 does not reach the stoichiometric air-fuel ratio. After the oxygen absorbed by the catalyst finishes reacting with the added fuel, the oxygen in exhaust gas starts reacting with the added fuel. Accordingly, the air-fuel ratio of exhaust gas is decreased to or below the stoichiometric air-fuel ratio. Hereinafter, a period from the start of the rich period until the oxygen absorbed by the catalyst finishes reacting with the added fuel is referred to as an $O_2$ storage period P.

A final addition amount qf used for controlling the amount of fuel added from the fuel adding valve 68 during the rich period will now be described. The amount of fuel added from the fuel adding valve 68 is controlled by driving the fuel adding valve 68 by the ECU 70 such that the amount of fuel corresponding to the final addition amount qf is added by a single fuel addition. The final addition amount qf is calculated based on the following equation (3).

$$qf=qb\times k+qi/n \tag{3}$$

Where:

qf: Final addition amount qb: Base addition amount k: ratio (qfi−1/qfi−2) between the previous qf (qfi−1) and the further previous qf (qfi−2)

qi: Integral term (qi=previous qi+variable value A)

n: number of fuel addition to which integral term is reflected

The base addition amount qb in the equation (3) is determined in advance as a theoretical value of the added amount of fuel, which corresponds to the amount of fuel that is added by a single fuel injection addition so as to make the air-fuel ratio equal to the target air-fuel ratio.

Fuel additions the number of which is n times are referred to as one set. The integral term qi in the equation (3) is a value selectively increased and decreased per one set of fuel additions to execute the feedback control. The integral term qi is calculated as a correction value of the fuel addition amount per each set. The feedback control using the integral term qi is executed during the rich period and after the $O_2$ storage period P has ended (hereinafter, referred to as a feedback control period F). When it is not during the feedback control period F, the integral term qi is set to zero. On the other hand, during the feedback control period F, the integral term qi is computed each time one set of fuel addition (n times of fuel additions) is performed by adding the variable value A to the integral term qi of the pervious calculation. As the actual air-fuel ratio obtained based on the detection signal from the air-fuel ratio sensor 48 becomes leaner than the target air-fuel ratio, the variable value A becomes a positive value and is increased. On the other hand, as the actual air-fuel ratio becomes richer than the target air-fuel ratio, the variable value A becomes a negative value and is decreased. Through variation of the variable value A as described above, the integral term qi is selectively increased and decreased as a value for feedback controlling the air-fuel ratio of exhaust gas to the stoichiometric air-fuel ratio. The integral term qi that is selectively increased and decreased as described above is safeguarded from exceeding a predetermined upper limit so that the final addition amount qf is not excessively increased, and is safeguarded from being less than a predetermined lower limit so that the final addition amount qf is not excessively decreased. The integral term qi is computed as the correction value of the fuel addition amount corresponding to one set of fuel addition (n times of fuel additions). Therefore, the integral term qi is reflected in the final addition amount qf after being divided by the number of times n of fuel addition (qi/n).

The ratio K in the equation (3) is the ratio between the final addition amount qf at the end of the next previous rich period (qfi−1) and the final addition amount qf at the end of the one before last rich period (qfi−2). By multiplying the base addition amount qb by the ratio K, the correction amount of the fuel addition amount adjusted by the integral term qi through the feedback control in the next previous rich period is reflected in the base addition amount qb used in the calculation of the final addition amount qf in the current rich period. Therefore, the ratio K in the equation (3) is a value for reflecting the correction of the fuel addition amount by the feedback control that has been performed during the S release control to the final addition amount qf (base addition amount qb) in the current rich period. The ratio K set as described above is safeguarded from exceeding a predetermined upper limit so that the final addition amount qf is not excessively increased, and is safeguarded from being less than a predetermined lower limit so that the final addition amount qf is not excessively decreased.

In the S release control, there is a case where the air-fuel ratio of exhaust gas obtained based on the detection signal from the air-fuel ratio sensor 48 becomes always lean although fuel is added from the fuel adding valve 68 due to an abnormality that occurs during the control. The abnormality includes a case (A) where the air-fuel ratio sensor 48 malfunctions and outputs only signals indicating the lean state and a case (B) where the actual fuel addition amount becomes less than the final addition amount qf due to, for example, clogging of the fuel adding valve 68.

Under such abnormal circumstances, when the feedback control is executed after the $O_2$ storage period P ends, the integral term qi increases such that the air-fuel ratio of exhaust gas approaches the target air-fuel ratio (14.3). When the fuel addition state is shifted from the rich period to the lean period, the ratio K is set to a value greater than 1.0 by an amount the fuel addition amount is increased by the integral term qi during the feedback control in the current rich period. The ratio K is then used for increasing the fuel addition amount in the next rich period. As shown in FIG. 2(*d*), the integral term qi is always increased at every feedback control period F. As shown in FIG. 2(*c*), the ratio K is increased in a step-by-step manner each time the fuel addition state shifts from the rich period to the lean period.

As described above, when there is an abnormality in the S release control, although the final addition amount qf is increased by the integral term qi and the ratio K, the air-fuel ratio of exhaust gas does not reach the value (14.5) at which the S components are released from the catalyst due to the reasons (A) and (B) as shown by the broken line in FIG. 2(*b*). In this case, since only the air-fuel ratio of exhaust gas obtained based on the detection signal from the air-fuel ratio sensor 48 becomes leaner than 14.5, the S poisoning amount Si is not decreased by the S decreased amount SD. Therefore, the S poisoning amount Si does not decrease to the end determination value (zero). As a result, the S release control procedure (S release control) cannot be ended. This deteriorates fuel consumption and excessively increases the catalyst bed temperature.

To avoid these problems, the ECU 70 may determine the existence of an abnormality during the S release control and take measures against the abnormality. However, if determining the existence of an abnormality takes time, the measures taken based on the determination result will be delayed. In this respect, according to the preferred embodiment, the existence of an abnormality is determined based on the air-fuel ratio of exhaust gas that is directly affected by the abnormality (the air-fuel ratio detected by the air-fuel ratio sensor 48) so that the determination is promptly and accurately made and measures are taken against the abnormality without delay.

Figure 3:
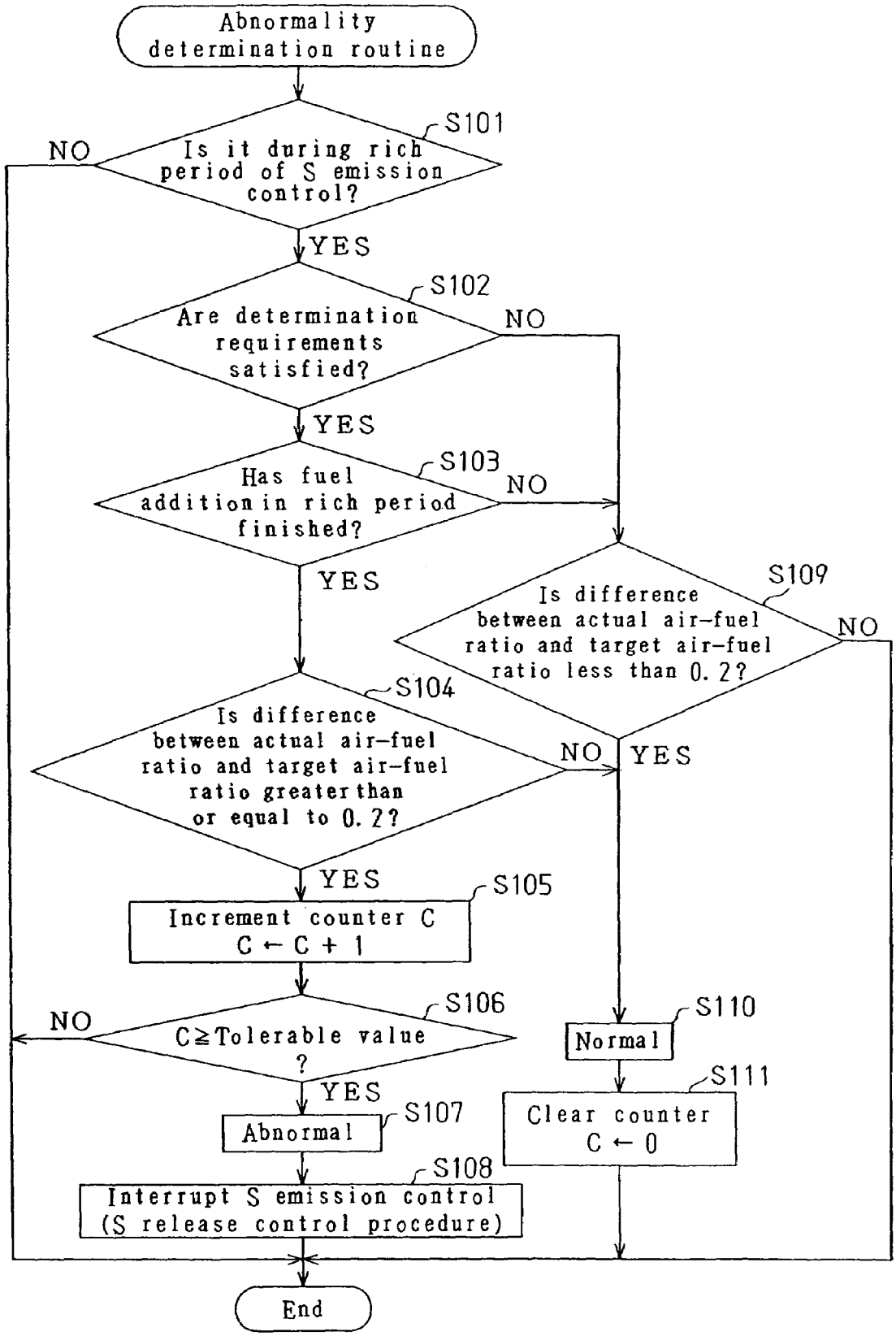
FIG. 3 is a flowchart showing a procedure for determining whether there is an abnormality in the S release control and a procedure for taking measures against the abnormality.

A procedure for determining the existence of an abnormality during the S release control and a procedure for taking measures against the abnormality will now be described with reference to the flowchart of FIG. 3 showing an abnormality determination routine. The abnormality determination routine is executed as an interrupt at predetermined time intervals during the S release control.

In the abnormality determination routine, if it is during the rich period of the S release control, that is, if the decision outcome of step S101 is positive, the ECU 70 determines whether requirements for determining the existence of an abnormality in the control are satisfied in step S102. The determination of whether the requirements are satisfied is made based on whether the following requirements are all satisfied.

(Requirement 1) The period of the S release control is other than the $O_2$ storage period P.

(Requirement 2) A predetermined time has elapsed since the period of the S release control shifted to the feedback control period F.

(Requirement 3) The ratio K is safeguarded from exceeding the upper limit (limit of the rich state).

(Requirement 4) The integral term qi is safeguarded from exceeding the upper limit (limit of the rich state).

As for the requirement 1, the ECU 70 determines that the current period of the S release control is other than the $O_2$ storage period P when a time required for consuming the oxygen absorbed in the catalyst has elapsed since the rich period started.

When the requirements are all satisfied, that is, when the decision outcome of step S102 is positive, a procedure for determining the existence of an abnormality in the S release control (S103 to S106) is executed.

In this series of processes, when addition of fuel is finished in the rich period, that is, when the decision outcome of step S103 is positive, the ECU 70 determines whether the difference between the actual air-fuel ratio of exhaust gas obtained based on the detection signal from the air-fuel ratio sensor 48 and the target air-fuel ratio (14.3) is greater than or equal to 0.2 in step S104. In other words, the ECU 70 determines whether the actual air-fuel ratio of exhaust gas has not reached the stoichiometric air-fuel ratio (14.5) at which the S components are released from the catalyst. If the decision outcome of step S104 is positive, a counter C is incremented by one at step S105. The counter C represents the number of times the ECU 70 determined that the actual air-fuel ratio of exhaust gas has not reached the stoichiometric air-fuel ratio at the end of the rich period. At step S106, the ECU 70 determines whether the value of the counter C is greater than or equal to a permissible value. If the decision outcome of step S106 is positive, the ECU 70 determines that there is an abnormality in the S release control at S107. Furthermore, if it is determined that there is an abnormality in the S release control, the ECU 70 subsequently interrupts the S release control (S release procedure) as measures against the abnormality at step S108. Thus, the air-fuel ratio of exhaust gas is returned to a normal value.

On the other hand, at step S104, if the ECU 70 determines that the difference between the actual air-fuel ratio of exhaust gas and the target air-fuel ratio (14.3) is not greater than or equal to 0.2 and the actual air-fuel ratio of exhaust gas has reached the stoichiometric air-fuel ratio (14.5) at which the S components are released from the catalyst, there is no abnormality in the S release control. This is because if the actual air-fuel ratio of exhaust gas has reached the stoichiometric air-fuel ratio, the S poisoning amount Si will be decreased to the final determination value (zero) in accordance with the S decreased amount SD, and the S release control will be ended in a normal manner. In this case, the ECU 70 determines that the S release control is normal at step S110 and clears the counter C in the following step S111.

If the decision outcome of step S102 or step S103 is negative, the ECU 70 proceeds to step S109 and determines whether the difference between the actual air-fuel ratio of exhaust gas and the target air-fuel ratio is less than 0.2. In other words, the ECU 70 determines whether the actual air-fuel ratio of exhaust gas is less than or equal to the stoichiometric air-fuel ratio. If the decision outcome of step S109 is positive, the S poisoning amount Si will be decreased to the final determination value (zero) by addition of fuel from the fuel adding valve 68, and the S release control will be ended in a normal manner. Therefore, in this case also, the ECU 70 determines that the S release control is normal at step S110 and clears the counter C in the following step S111.

The above described embodiment has the following advantages.

(1) During the S release control, the ECU 70 determines whether the actual air-fuel ratio of exhaust gas detected by the air-fuel ratio sensor 48 has reached the stoichiometric air-fuel ratio each time the rich period ends at which addition of fuel from the fuel adding valve 68 is stopped. The number of times the ECU 70 has determined that the actual air-fuel ratio of exhaust gas has not reached the stoichiometric air-fuel ratio is counted by the counter C. When the value of the counter C becomes greater than or equal to the permissible value, the ECU 70 determines that there is an abnormality in the S release control. In determining the existence of an abnormality in the S release control, as the permissible value is set greater, the time required to make a determination becomes longer. However, the determination is made with more accuracy. In this embodiment, the existence of an abnormality is determined based on the air-fuel ratio of exhaust gas (the air-fuel ratio detected by the air-fuel ratio sensor 48), which is directly affected by the abnormality caused in the S release control such as malfunction of the air-fuel ratio sensor 48 and clogging of the fuel adding valve 68. The air-fuel ratio of exhaust gas is a parameter the convergence of which with the target air-fuel ratio in the feedback control period F immediately deteriorates if an abnormality occurs in the S release control. Therefore, when determining the existence of an abnormality in the S release control, the determination is made accurately without setting the time required for making determination longer, that is, without increasing the permissible value. Therefore, the existence of an abnormality in the S release control is promptly and accurately determined.

(2) The determination of whether the actual air-fuel ratio detected by the air-fuel ratio sensor 48 has reached the stoichiometric air-fuel ratio is made on conditions that the ratio K is safeguarded from exceeding the upper limit and the integral term qi is safeguarded from exceeding the upper limit. The state in which the ratio K and the integral term qi are safeguarded from exceeding the upper limits is a state in which the actual air-fuel ratio of exhaust gas is controlled to approach the target air-fuel ratio (14.3) as much as possible. In this state, if the actual air-fuel ratio has not reached the stoichiometric air-fuel ratio (14.5), there is a high possibility that an abnormality has occurred in the S release control. Therefore, since the ECU 70 determines whether the actual air-fuel ratio of exhaust gas has reached the stoichiometric air-fuel ratio on conditions that the ratio K and the integral term qi are safeguarded from exceeding the upper limit, the existence of an abnormality in the S release control is further accurately determined based on the value of the counter C being greater than or equal to the permissible value.

(3) The determination of whether the actual air-fuel ratio of exhaust gas has reached the stoichiometric air-fuel ratio is made at the end of the rich period at which addition of fuel from the fuel adding valve 68 is stopped, that is, when the feedback control is sufficiently performed. Therefore, the reliability of the determination result is increased. Accordingly, the existence of an abnormality in the S release control is further accurately determined based on the value of the counter C being greater than or equal to the permissible value.

(4) When it is determined that an abnormality has occurred in the S release control, the S release control is interrupted so that the air-fuel ratio of exhaust gas returns to the normal value. This suppresses deterioration of the fuel consumption and excessive increase of the catalyst bed temperature due to unnecessary continuation of richening the air-fuel ratio of exhaust gas toward the target air-fuel ratio.

(5) When the air-fuel ratio of exhaust gas reaches the stoichiometric air-fuel ratio during the rich period of the S release control, the ECU 70 determines that the S release control is normal and clears the counter C. When the air-fuel ratio of exhaust gas reaches the stoichiometric air-fuel ratio during the rich period, the S poisoning amount Si will be decreased to the final determination value (zero) by the decreased amount SD so that release of the S components from the catalyst is completed, and the S release control will be ended. In this case, since the ECU 70 determines that the S release control is normal, the determination of the existence of an abnormality in the control is prevented from being unnecessarily continued.

The above described embodiment may be modified as follows.

When it is determined that an abnormality has occurred in the S release control, the ECU 70 may, as a measure against the abnormality, inform the driver of the abnormality with a warning lamp or other indicator instead of interrupting the control.

The determination of whether the air-fuel ratio of exhaust gas has reached the stoichiometric air-fuel ratio may be made before the end of the rich period and after a certain time has elapsed since the feedback control period F has started instead of at the end of the rich period.

Requirement (3) may be changed so that the ratio K has reached a predetermined value close to the upper limit.

Requirement (4) may be changed to that the integral term qi has reached a predetermined value close to the upper limit.

In the preferred embodiment, the target air-fuel ratio in the S release control is set to 14.3, but the target air-fuel ratio may be other values less than the stoichiometric air-fuel ratio.

The final determination value in the S release control may be other than zero. For example, the final determination value may be set to a value slightly greater than zero.

The present invention may be applied to a lean combustion gasoline engine that employs a catalyst having the same structure as the preferred embodiment.

What is claimed is:

1. An exhaust purifying apparatus for sulfur release control in an internal combustion engine that performs lean combustion, the engine having an exhaust purifying catalyst that is caused to release sulfur accumulated from exhaust gas produced, the exhaust purifying apparatus comprising:

detecting means for detecting the air-fuel ratio of exhaust gas of the internal combustion engine;

determining means for repeatedly determining at a predetermined timing during a feedback control, whether the air-fuel ratio detected by the detecting means has reached a stoichiometric air-fuel ratio at which sulfur is released from the exhaust purifying catalyst; and abnormality diagnosing means for counting the number of times the determining means has determined that the air-fuel ratio is leaner than the stoichiometric air-fuel ratio, and when the number of times becomes greater than or equal to a permissible value, for determining that there is an abnormality in the sulfur release control;

wherein, when executing sulfur release control, the feedback control is executed to equalize the air-fuel ratio with either of the stoichiometric air-fuel ratio or a target air-fuel ratio richer than the stoichiometric air-fuel ratio by selectively increasing and decreasing a correction value for richening the air-fuel ratio of exhaust gas of the internal combustion engine in accordance with said air-fuel ratio.

2. The exhaust purifying apparatus according to claim 1, wherein the determining means determines whether the air-fuel ratio has reached-the stoichiometric air-fuel ratio based on a condition that the correction value is equal to either a limit value of a rich state or a value close to the limit value.

3. The exhaust purifying apparatus according to claim 1, wherein the sulfur release control repeats a rich period during which the air-fuel ratio is less than or equal to the stoichiometric air-fuel ratio and a lean period during which the air-fuel ratio is lean, and the exhaust purifying apparatus executes the feedback control during the rich period, wherein the determining means determines whether the air-fuel ratio has reached-the stoichiometric air-fuel ratio at a timing in correspondence with the rich period being shifted to the lean period.

4. The exhaust purifying apparatus according to claim 1, further comprising:

restoring means, wherein, when the abnormality diagnosing means determines that an abnormality has occurred in the sulfur release control, the restoring means interrupts the sulfur release control and restoring the air-fuel ratio of exhaust gas to a normal value.

5. The exhaust purifying apparatus according to claim 1, wherein, when the air-fuel ratio reaches the stoichiometric air-fuel ratio while the sulfur release control is being performed, the abnormality diagnosing means determines that the sulfur release control is normal and clears the number of times the determining means has determined that the air-fuel ratio has not reached the stoichiometric air-fuel ratio.

6. An internal combustion engine that performs lean combustion, the engine producing motive force by taking in air and fuel and producing exhaust gas containing sulfur during operation, the internal combustion engine comprising:

an exhaust purifying catalyst, which accumulates sulfur contained in the exhaust gas for purifying the exhaust gas; and an exhaust purifying apparatus for executing sulfur release control for causing the exhaust purifying catalyst to release the sulfur, in which the apparatus executes a feedback control to equalize the air-fuel ratio with either of a stoichiometric air-fuel ratio or a target air-fuel ratio richer than the stoichiometric air-fuel ratio by selectively increasing and decreasing a correction value for richening the air-fuel ratio of the exhaust gas in accordance with the air-fuel ratio, the exhaust purifying apparatus including:

detecting means for detecting the air-fuel ratio of the exhaust gas;

determining means for repeatedly determining at a predetermined timing during the feedback control, whether the air-fuel ratio detected by the detecting means has reached the stoichiometric air-fuel ratio at which sulfur is released from the exhaust purifying catalyst; and abnormality diagnosing means for counting the number of times the determining means has determined that the air-fuel ratio is leaner than the stoichiometric air-fuel ratio, and wherein, when the number of times becomes greater than or equal to a permissible value, the abnormality diagnosing means determines that there is an abnormality in the sulfur release control.

7. The internal combustion engine according to claim 6, wherein the determining means determines whether the air-fuel ratio has reached-the stoichiometric air-fuel ratio based on a condition that the correction value is equal to either a limit value of a rich state or a value close to the limit value.

8. The internal combustion engine according to claim 6, wherein the sulfur release control repeats a rich period during which the air-fuel ratio is less than or equal to the stoichiometric air-fuel ratio and a lean period during which the air-fuel ratio is lean, and the exhaust purifying apparatus executes the feedback control during the rich period, wherein the determining means determines whether the air-fuel ratio has reached the stoichiometric air-fuel ratio at a timing in correspondence with the rich period being shifted to the lean period.

9. The internal combustion engine according to claim 6, wherein the exhaust purifying apparatus further comprises:

restoring means, wherein, when the abnormality diagnosing means determines that an abnormality has occurred in the sulfur release control, the restoring means interrupts the sulfur release control and restores the air-fuel ratio of exhaust gas to a normal value.

10. The internal combustion engine according to claim 6, wherein, when the air-fuel ratio reaches the stoichiometric air-fuel ratio while the sulfur release control is being performed, the abnormality diagnosing means determines that the sulfur release control is normal and clears the number of times the determining means has determined that the air-fuel ratio has not reached the stoichiometric air-fuel ratio.

11. An exhaust purifying method for an internal combustion engine that performs lean combustion, in which method a sulfur release control is executed for releasing, from an exhaust purifying catalyst, sulfur that accumulates from exhaust gas, the exhaust purifying method comprising:

executing feedback control to equalize the air-fuel ratio with either of a stoichiometric air-fuel ratio or a target air-fuel ratio richer than the stoichiometric air-fuel ratio by selectively increasing and decreasing a correction value for richening the air-fuel ratio of the exhaust gas in accordance with the air-fuel ratio;

detecting the air-fuel ratio of the exhaust gas;

repeatedly determining at a predetermined timing during said executing feedback control, whether the air-fuel ratio detected during said detecting has reached the stoichiometric air-fuel ratio at which sulfur is released from the exhaust purifying catalyst; and counting the number of times the air-fuel ratio is determined to be leaner than the stoichiometric air-fuel ratio in said repeatedly determining, and when the number of times becomes greater than or equal to a permissible value, diagnosing that there is an abnormality in the sulfur release control.

12. The exhaust purifying method according to claim 11, wherein in said determining, the determination of whether the air-fuel ratio has reached the stoichiometric air-fuel ratio is performed based on a condition that the correction value is equal to either a limit value of a rich state or a value close to the limit value.

13. The exhaust purifying method according to claim 11, wherein, in said executing sulfur release control, a rich period during which the air-fuel ratio is less than or equal to the stoichiometric air-fuel ratio and a lean period during which the air-fuel ratio is lean are repeated, wherein said executing feedback control is performed during the rich period, and wherein, in said repeatedly determining, whether the air-fuel ratio has reached the stoichiometric air-fuel ratio is determined at a timing in correspondence with the rich period being shifted to the lean period.

14. The exhaust purifying method according to claim 11, further comprising:

interrupting the sulfur release control and restoring the air-fuel ratio of exhaust gas to a normal value when, in said diagnosing, the sulfur release control is diagnosed to have caused an abnormality.

15. The exhaust purifying method according to claim 11, wherein said diagnosing includes:

determining that the sulfur release control is normal when the air-fuel ratio reaches the stoichiometric air-fuel ratio in said executing feedback control; and clearing the number of times the air-fuel ratio is determined not to have reached the stoichiometric air-fuel ratio.

* * * * *